US005735335A

United States Patent [19]

Gilmore et al.

[11] Patent Number: 5,735,335

[45] Date of Patent: Apr. 7, 1998

[54] INVESTMENT CASTING MOLDS AND CORES

[75] Inventors: James Randall Gilmore, Ligonier; Lawrence J. Rhoades, Pittsburgh, both of Pa.

[73] Assignee: Extrude Hone Corporation, Irwin, Pa.

[21] Appl. No.: 501,511

[22] Filed: Jul. 11, 1995

[51] Int. Cl.[6] ..... B22C 9/00; B22D 31/00

[52] U.S. Cl. ..... 164/516; 164/70.1

[58] Field of Search ..... 164/516, 517, 164/6, 70.1, 69.1

[56] References Cited

U.S. PATENT DOCUMENTS 5,187,899 2/1993 Rhoades ..... 51/59

5,465,780 11/1995 Muntner et al. ..... 164/516

FOREIGN PATENT DOCUMENTS 1-240224 9/1989 Japan .

*Primary Examiner*—Joseph J. Hail, III

*Assistant Examiner*—I.-H. Lin

*Attorney, Agent, or Firm*—Waldron & Associates

[57] ABSTRACT

Investment casting molds, and particularly mold cores, are formed of sintered ceramics to near net shape and are then machined to net shape, dimensions and surface finish, by ultrasonic machining with formed tools having the final configuration in mirror image form. Form machining of fired mold shells and cores is rapid, precise, readily controlled, and can produce castings of exceptional accuracy of shape, dimensions and surface finish.

20 Claims, 2 Drawing Sheets

INVESTMENT CASTING MOLDS AND CORES

BACKGROUND OF THE INVENTION

1. Technical Field

The present invention relates to the field of investment casting and to improved molds and cores for higher precision and accuracy of casting. Investment cast articles are widely used in most industries, and improved production techniques are of great importance.

2. Introduction

Investment casting is an old art, but one that holds considerable continuing import in many industries, and is the technique of choice in the fabrication of intricately shaped parts and particularly of parts having complex or inaccessible internal bores, cavities, or chambers.

In general terms, investment casting is based on the formation of a part to be formed in wax or a wax-like material, dimensioned to allow for shrinkage of the cast metal as it cools, which is coated with a ceramic refractory shell. The wax material is removed from the shell, leaving a cavity having the conformation of the original wax part. The ceramic is fired to sinter the particles, forming a solid mold having a cavity adapted to receive molten metal. The cavity is filled with molten metal, which is then cooled to solid form. The shell is removed, by hammering or sand blasting or the like, and the cast part is recovered.

After trimming, cleaning, grinding, polishing, and similar finishing operations, a finished part is provided. As a general matter, the dimensional precision of investment castings can be quite respectable, and the grinding operation employed as an element of finishing can produce parts of substantially any degree of precision and accuracy required.

It has become common to employ core inserts in the mold to provide the basis for hollow elements in the casting. Indeed, it is possible through the employment of mold core inserts to form parts which cannot be formed by any other technique. Such internal structures may be important to control weight of the casting, or to provide flow paths for fluids, or the like. The hollows needed for a particular part may be more conveniently formed as part of the casting operations rather than requiring a separate and additional machining or boring operation, and there are many castings formed with hollow internal forms that cannot be formed by machining techniques at all.

When mold core inserts are employed, they are commonly formed separately from the shell, of refractory ceramic materials the same as or comparable to those employed to form the mold shell. Like the shell into which they are inset, cores or inserts must be dimensioned to allow for shrinkage, and must be placed, positioned and supported within the shell with accuracy and precision.

After casting, the core material is removed by techniques generally the same as those employed for removing the shell, which may be supplemented by chemical removal of the material in regions that are not accessible to hammering or sand blasting operation. The necessity for chemical removal may limit the selection of materials for the core.

There are a variety of techniques for forming mold inserts and cores, which may be of quite elaborate and delicate shapes and dimensions. An equally diverse number of techniques are employed to position and support the inserts in the shells. The most common technique for supporting cores within mold structures is the placement of modestly sized ceramic pins, which may be formed integrally with the shell or the core or both, which project from the surface of the shell to the surface of the core structure, and serve to locate and support the core insert. After casting, the holes in the casting are filled, as by welding or the like, preferable with the alloy of which the casting is formed.

Investment casting techniques are susceptible to a number of imprecisions. While external imprecisions can often be corrected with conventional machine shop techniques, those encountered in internal structural forms produced by cores are difficult and often impossible to resolve.

Internal imprecisions and inaccuracies stem from known factors. These are, generally, a lack of precision in the formation of the core structure, a lack of precision in the inserting of the core in the shell in the fabrication, assembly of the mold, unanticipated changes or defects introduced during firing of the ceramic shapes, and failure of the shell, core insert or mounting elements during fabrication, assemble and handling prior to or during the casting operation.

The precise and accurate shaping, dimensioning and positioning of the core insert has been the most intractable difficulty in the production of molds. It was these aspects of investment casting which initiated our efforts, although the methodology of the present invention has proved to have broader applicability.

Typically, mold shell and core formation have been limited in the ability to reliably form fine detail with reasonable levels of resolution. In terms of the accuracy of positioning and registration, reliable dimensions, and the generation of intricate and detailed shapes, such systems have been quite limited.

The core inserts are typically castings or moldings, employing usual ceramic casting or molding, followed by appropriate firing techniques. It is inherent in the nature of ceramic casting that accuracy and precision are substantially less than those achieved by metal casting techniques. There is far greater shrinkage in the usual ceramic casting formulations or "slips" with a much greater tendency to form cracks, bubbles, and other defects. There is accordingly a high failure and reject rate in the production of metal investment castings stemming from incorrectable defects caused by faulty cores and core placement, and a high casting working requirement to correct those castings which are out of specifications, but amenable to correction by machining, grinding and the like. The productivity and efficiency of investment casting operations are substantially hindered by such requirements.

Another limiting feature of investment casting has been the very considerable tool development lead time, and the very intensive level of labor and effort required in tooling development. The development of each stage of the tooling, including particularly the shape and dimensions of the wax forms, the shape and dimension of the green bodies, and the net shape of the fired molds, particularly cores, and the resulting configuration and dimensions of the casting produced in the molds are affected by a large number of variables, including warpage, shrinkage and cracking during the various forming steps, and particularly during the firing of the ceramic green bodies. As those of ordinary levels of skill in the art are well aware, these parameters are not closely predictable, and the development of investment casting molds is a highly iterative and empirical trial and error process, which for complex castings typically extends over periods of twenty to fifty weeks before the process can be put into production.

As a result, complex precision investment casting, of hollow parts in particular, is limited to the production of parts and casting in substantial number and is generally not feasible for limited production runs. Changes in design of the casting require tooling rework of comparable magnitude, and are thus quite expensive and time consuming.

PRIOR ART

The art has given attention to these problems, and has made progress in the employment of superior ceramic formulations which reduce the incidence of such problems to some degree.

While these techniques have resulted in improvements, they add to the expense of the casting operation, ad do not achieve all the improvement which might be desired.

For those techniques which employ working and particularly machining on green bodies, experience has shown that the changes in dimension during firing of the ceramic body introduces a number of imprecisions which limit the attainment of the targeted shape and dimensions in the fired body. Because of the fragility of green bodies, the techniques which can be employed are limited, and considerable hand work is ordinarily required. Even with the best of precautions and care, a substantial proportion of the cores will be damaged by the working operations.

Most importantly, the features of the prior art to date do little to improve the tool development cycle, or to reduce the number of iterations required to produce final tooling of the required precision and accuracy of shape and dimensions. The prior art does not afford effective techniques to rework mold shells and cores which are out of specifications, or to alter the net shapes to accommodate design changes without repeating the tool development process.

OBJECTS OF THE INVENTION

It is an object of the present invention to provide investment casting molds and particularly mold core inserts of high and improved dimensional accuracy and precision.

It is another object of the present invention to provide a method for the production of investment casting molds and particularly mold cores of high and improved dimensional accuracy and precision.

Another object is to reduce the tool development cycle to produce investment casting molds and cores of high accuracy and dimensions.

Still another object is to provide techniques for the reclamation of investment casting cores and molds which are out of allowable specifications, to produce castings of high precision and accuracy.

Yet another object of the present invention is the provision of techniques to alter the shape and dimensions of investment casting molds and cores to provide for design changes without repeating the tool development cycle.

SUMMARY OF THE INVENTION

In the present invention, investment casting molds, and particularly mold core inserts of high and reproducible accuracy and precision are formed by casting the core insert of a ceramic, firing the ceramic, and machining the ceramic shell or core element to the required degree of accuracy and precision by the use of one or more ultrasonic machining techniques, and particularly form machining techniques on the fired ceramic.

Indeed, the shell or core insert may be machined from blocks or "bar stock" of presintered ceramic material with uniform porosity to allow for shrinkage in subsequent processing and handling, and the surfaces may be coated after machining to provide a smooth surface for casting. The smooth surface of the ceramic will produce a corresponding smooth surface on the metal casting to be formed in the mold. It is possible to make such blocks or "bar stock" of pre-sintered ceramic materials with very uniform and highly predictable shrinkage properties, premitting a more precise casting compared with cores that are formed by the techniques usual in the art whose porosity and shrinkage properties may vary considerably.

One of the greatest benefits of the procedures of the present invention is the reduction of the lead time to produce parts, and the acceleration of the process of developing the molds. The iterative process of development common in the art is greatly reduced because there is no need to achieve a final shape which produces a net dimensioned mold configuration in the ceramic casting or molding operation. Since the net mold shapes can be readily adjusted, producing castings of the desired form and dimensions is not the difficult and time consuming, largely trial and error process commonly required in the art.

DETAILED DESCRIPTION

Figure 1:
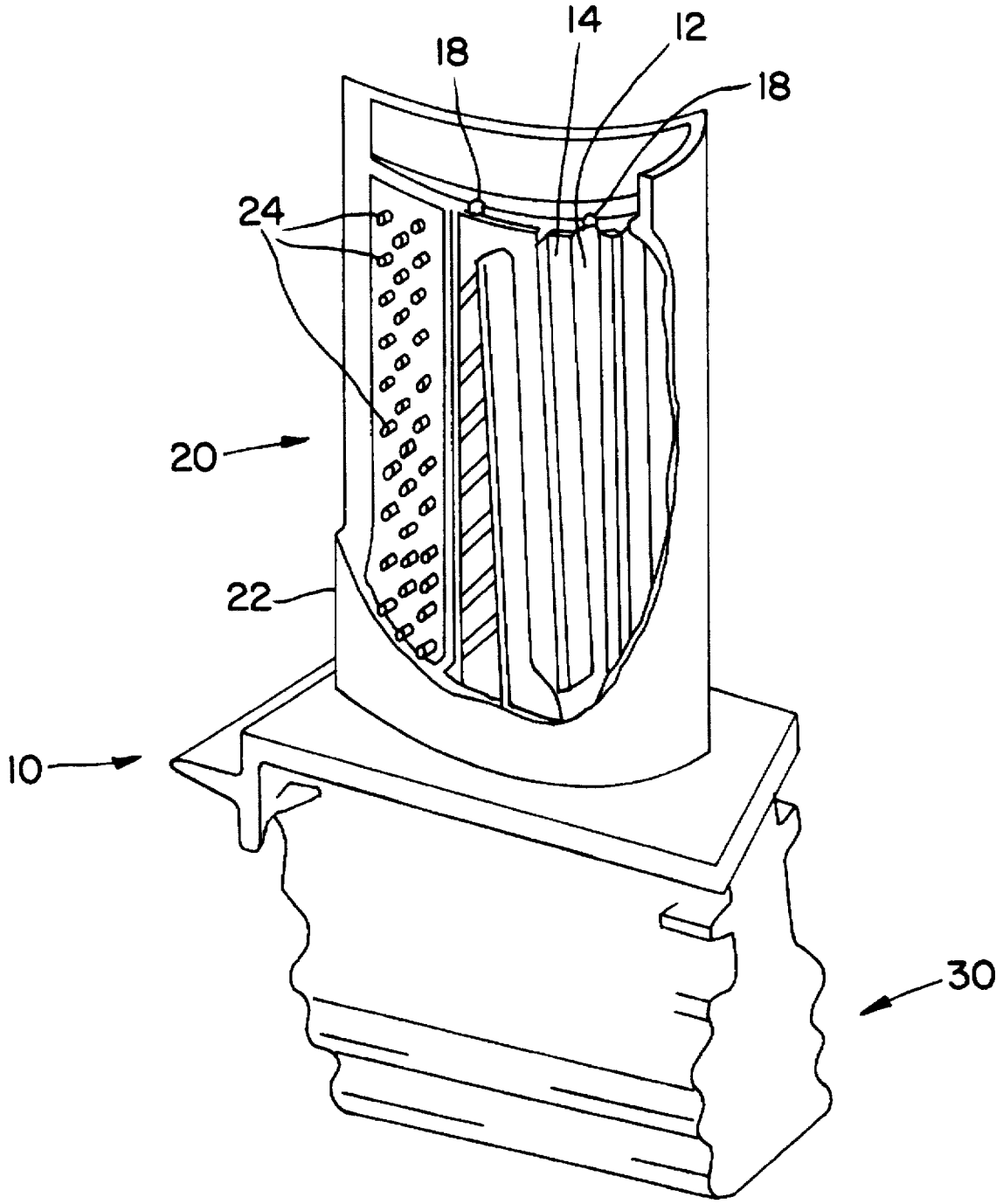
FIG. 1 is a perspective cut-away view of a stylized investment cast turbine engine blade structure, illustrating features formed in the present invention.

In the present invention, molds, and particularly cores, for investment casting are worked to the required degree of precision and accuracy of form and dimensions after firing to a fully sintered condition.

Such techniques have not heretofore been employed because of the difficulty of working hard, brittle ceramics suitable for use as investment casting cores. Traditional machining and other working techniques result in unacceptable levels of breakage and fracturing of ceramics to be of practical use.

We have developed point and form ultrasonic machining techniques which are fully effective and productive for use in working sintered and cured, fully hard and dimensionally stable ceramic bodies. By the use of these techniques, investment casting shells and cores of unparalleled precision, accuracy and detail are produced which are employed to produce investment casting which themselves have a consequential improvement in accuracy, precision, detail resolution and in surface finish, reducing the mold and casting reject rates, and minimizing the amount of work required on the casting.

In the present invention, the ultrasonic machining technique provides substantial advantages. It is immaterial that the ceramic structures are non-conductive and complex; three-dimensioned forms can be machined as readily and as rapidly as simple ones. There are no chemical or thermal alterations of the surfaces.

The lead time required to develop the molds and cores is greatly reduced, and modifications to the molds, cores and the final casting may be conveniently and rapidly accomplished.

While the procedures of the present invention are particularly significant to mold core inserts, because of the inaccessibility of the internal bores and cavities of castings for correction by traditional machining procedures, such as grinding, polishing, and the like, the present invention provides the first technique which is practical for the correction of mold components prior to casting, so that the casting is of greater precision and accuracy, saving the need for much of the working of castings. While working the fired mold shell may not be cost effective in all cases, it can represent significant improvements in some very complex and difficult to work shapes, and will be productive in such circumstances.

In the present invention, green bodies are formed by techniques which are conventional in the art. There are not specific consideration which are required to adapt the green bodies to the practice of the present invention, although there are some preferred features which may be desirable to maximize the benefits to be realized.

Foremost among these is to assure that the dimensions of the green body are not undersized in relation to design specifications, since in the present invention it is easy to remove excess materials by the machining procedure, but not to add material. While the green bodies should be formed to the closest tolerances reasonably possible, allowing for the appropriate amount of shrinkage during the firing of the green bodies, in keeping with good practice and to minimize the working requirements, if there is to be an error, it should be on the side of excess material which can be removed by reliance on the present invention. It is this aspect of the present invention which reduces the tooling development cycle from the usual twenty to fifty weeks to about two to four weeks in the practice of the present invention.

This is not to say that gaps, defects, hollows and other imperfections in green bodies cannot be repaired by the known techniques in the art, but it is generally preferable that these requirements be minimized.

All the compositions commonly employed in the art can be employed with the present invention. It is generally preferred that the formulations which are least in cost and highest in performance in the casting and mold removal procedures be employed; it is not necessary that the complex formulations developed to minimize shrinkage upon firing of the green bodies be employed. Such formulations often involve more expensive and demanding materials to work with, and may offer compromised performance during the pour of the molten metal or during the cooling of the casing. Such materials are often more difficult to dean from the casting as well. Because such "improved" formulations are necessary, we prefer to avoid their use in the present invention.

As a general rule, the smaller the particle sizes of the ceramic materials employed in the formation of the green bodies, the better will be the accuracy and tolerances of the final casting mold, and particularly the mold core inserts, and the comparable attributes and surface finish of the casting. For most ceramic formulations, it is preferred to employ the smallest available particle sizes of the component materials, at least in the regions of the mold which for the mold surfaces and dictate the "as cast" surface finish of the casting. Coarser materials may be advantageous in other regions of the mold structures.

As finishing operations such as grinding and polishing of investment castings are time consuming, labor intensive, and expensive aspects of foundry practice, all improvements in the as-cast conditions of the castings which serve to minimize the finishing operations and the need for corrections, the greater the productivity, efficiency and economy of production.

The selection of green body binders is not critical to the present invention, for the same reasons set out above. As a general rule, the green bodies will not be subjected to working to control dimensions, and for that reason, the green body strength, often dictated primarily by the selection of the binder formulation to withstand the requirements of such working, is not as significant to the formation of green bodies for use in the present invention. As a result, less expensive materials may be used, with attendant savings in the cost of the forming operation.

Depending on the type of forming operation to be used to form the green bodies, the binder may be a water soluble inorganic binder, such as water glass, a water soluble organic polymer, such as polyvinyl acetate or polyvinyl alcohol, or a natural or synthetic polymer hydrogel, such as guar gum or poly(hydroxyethyl methacrylate), or the like. In other contexts, the binder may be a plastic binary, particularly a thermoplastic polymer binder, or a polymer which can be thermoset after forming by the application of heat, such as phenolics, polyepoxides, polyurethanes and the like. (Such materials are removed by thermal degradation during firing operations, and are not generally present when the machining operations of the present invention are employed.)

Indeed, the low strength requirements of the green bodies in the present invention will permit the dilution of the ceramic formulation with inert refractory diluents as fillers in the composition, affording still greater saving in material costs.

In addition to cost savings through the use of less expensive diluents in the ceramic formulations, the present invention permits the use of fillers to facilitate the molding and casting characteristics of the ceramic molding formulations or slips, which can materially aid the facility of forming the green bodies. For example, it is possible to include in ceramic slips fillers which alter the theology of the slips in response to shear, providing a high degree of thixotropy to facilitate pumping, while minimizing sag or slump on standing.

The ceramic green body forms of the present invention maybe formed by any of the usual techniques employ in the art. Including by way of example casting of fluid dispersions molding of plastic dispersions, and static pressing.

Since the demands for green body strength in the present invention are modest and unremarkable, the casting technique employed is not a major factor in the quality or productivity of the operation, and can be selected on the basis of convenience and cost considerations in most circumstances.

Dip casting may be the technique of choice for the formation of mold shells, wherein the wax form is dipped into a slip, or dispersion of the ceramic components in a fluid, frequently an aqueous medium with a water soluble or hydrogel binder. The solids deposit on the surface of the form, and form a coating conforming to the shape of the form. Spray coating of the ceramic slip may also be employed. By multiple dipping or spraying operations, employing one or more slip formulations, to provide a suitable thickness of the coating to function as a mold shell, with or without drying between coatings, the formed shell is dried, the was form is removed, generally by heat or chemical action in conventional fashion, and the green body is then ready for firing to sinter the ceramic.

Dip casting techniques are less favored for the formation of cores, as the control of the process is more difficult when the ceramic is deposited on the interior of female forms. It is common to have void which represent defects in the green bodies when the mold is removed. For that reason, molding procedures are generally preferred for the formation of cores.

In molding operations, the ceramic formulation is dispersed in a suitable binder to form a plastic molding composition, which is formed in a female mold or form. The forming may be accomplished by injection molding at relatively elevated temperature, or any of the many related plastic molding variations know in the art.

The formed green bodies may be enhanced, in some cases, by isostatic pressing, including hot pressing, to densify the ceramic materials prior to firing.

In highly demanding situations, the green bodies may be reinforced by the inclusion of fibrous reinforcing or armatures, formed of ceramic or metallic fibers, to support the structural elements of the form.

When armatures are employed, care should be taken that the armature is positioned so that it is not exposed at the surface or so near the surface so that it will not become exposed on subsequent working.

When ceramic or metallic fibers are included, it is preferred they not be incorporated into the slip or molding formulation which forms the surface or is subjected to subsequent working.

In both cases, it is undesirable if reinforcing materials, and particularly metals, are exposed at the surface of the completed mold or come into contact with the molten metal being cast in the mold. Contamination of the casting alloy by extraction or diffusion from such inclusions in the mold structure is generally undesirable.

As is understood as normal in the art, the green bodies produced in keeping with the state of the art are fragile and relatively easy to damage. The usual precautions in handling these structures is required in the present invention as in any other investment casting operation.

There is no requirement for working of green bodies in the practice of the present invention, but it may be desirable to add material to fill surface defects or to increase wall thickness in some cases. When such techniques are employed, it is acceptable and even desirable to add some excess material, so that within reasonable limits, the procedure is quite undemanding and facile.

The firing of the green bodies is the least controllable and least predictable step in the formation of investment casting molds, and the one most determinative of the quality of the casting to be produced. The present invention does not operate to make the procedures more controllable or more predictable; in the present invention, the quality of the shape, dimensions and surface finish of the mold elements and the resulting shapes, dimensions and surface finish of the casting to be produced in the mold are not controlled by the firing step, or by the condition of the mold elements as fired. Firing is accordingly a far less demanding aspect of the practice of investment casting in the present invention. Since the shape and dimension of the fired mold are to be worked in the present invention, it is sufficient to achieve a near net shape in the fired body prior to working.

The firing operation itself will be dictated by the sinter requirements of the ceramic and the burn-out requirements of the green body binder. Heating schedules, holding time at temperature, and cooling schedules are known in the art and are not altered in the present invention.

It should be noted that the present invention does not eliminate the requirements of good design and fabrication practice in the development of green bodies. Upon firing, the ceramic material will still undergo the usual amounts of shrinkage, and care must be taken to avoid slumping and cracking of the form during the firing operation. It will also be evident to those of ordinary skill in the art that the extent of working of the fired mold elements will be dictated in large measure by the quality of the fired body, which is in turn dictated by the quality of the green body. The green body should accordingly be near the required shape and dimensions, developed to produce a fired ceramic of good quality and near the required net shape and dimensions necessary to produce the designated casting. In all circumstances in the present invention, it is greatly preferred that the green bodies be produced to such a "near-net" shape, with any variation from the target, net shape required in the casting operation favoring an over-sized green body. It is greatly preferred that the green body not be undersize.

Quantitatively, the green body should be developed to produce a fired mold which is at specifications, plus 1 mm, minus zero, preferably plus 0.1 mm, minus zero. As those of ordinarily skill will readily understand, development of green bodies to these required levels of precision and accuracy can ordinarily be accomplished with little difficulty and a limited number iterations. The closer to specifications without going under the designed values the fired body can be developed, the faster and less expensively the final shape can be produced when the mold is worked.

The structural and physical properties of the green bodies and the fired ceramic bodies are not altered in the present invention, and those of ordinary skill in the art will fully understand that these forms must treated with some care. The fired bodies, in particular, are hard, brittle and relatively fragile materials.

Rather than forming a green body to a "near net" shape, it may be quite effective in many contexts if the shell or core insert machined from standardized "blocks" or "bar stock" of presintered ceramic material. Such preformed and prefired "stock materials" can be formed with superior uniformity, and particularly uniform porosity to allow in turn for uniform and highly predictable shrinkage in subsequent processing and handling. The "stock material" is formed into the net shape required by the ultrasonic machining technique of the present invention, and the surfaces may be coated after machining to provide a smooth surface for casting; the coated shape may be re-fired, if required or wanted to fix the coating, depending on the composition employed. The smooth surface of the ceramic will produce a corresponding smooth surface on the metal casting to be formed in the mold. It is possible to make such blocks or "bar stock" of pre-sintered ceramic materials with very uniform and highly predictable shrinkage properties, premitting a more precise casting compared with cores that are formed by the techniques usual in the art whose porosity and shrinkage properties may vary considerably.

By the use of "stock material" in the technique, the need to injection mold, dip, isostatically press or otherwise form a green body is avoided. Stock shapes are far easier and more economical to produce, and their uniform shape, size and processing technique is far more reliable that the forming, firing and handling of complex and often delicate green bodies. Far less waste is experienced in such a technique.

It is well within the skill of the art to determine the net shape required of the fired mold to produce the required casting, with suitable allowances for shrinkage as the metal cools and solidifies. In the present invention, a mold core or shell is produced which is near, but not at, the net required shape and dimensions, and is then worked to machine the mold element to the final required shape and dimension, with a highly developed surface finish, with high levels of precision and accuracy.

Machining techniques for working ceramics are limited, and we have developed ultrasonic machining to provide rapid, highly regular and reproducible, and inexpensive working to the required degree of precision and accuracy in shape, dimensions and surface finish. The ultrasonic techniques we employ can be highly automated, limiting the highly skilled labor required, and can be conducted at processing rates equal to or faster than the production of the fired mold bodies.

The machining techniques can be employed to refine the fired mold elements, but it can also be employed to produce modifications in the mold, to afford features not readily produced in the usual forming operations. Small holes may be drilled into or through the mold structure, for example, with a precision in location, regularity and dimensions not practical in usual mold making operation.

Investment casting molds are often complex structures, corresponding to the castings to be produced. In addition, such molds require the normal additional parts required to make the casting, including, for example, sprues, gates, pouring cups, and the like. It is common in the art to add such structures to the wax form from which the mold structure is produced. Such procedures will ordinarily be preferred in the present invention as well, although it is worthy of note that additions can be cemented in place on the green body prior to firing, or to the fired mold, either before or after the working contemplated by the present invention.

Ultrasonic machining has become increasingly important in recent times for a variety of applications. It has been used to machine ceramics, among other materials, in a variety of contexts. It has not been employed in investment casting processes, or to work investment casting molds and mold components because the art has concentrated on other methodologies to produce superior molds. As noted above, it has generally been easier to alter the wax forms, adapt ceramic formulations or to work green bodies at earlier stages in the process, since these materials are far easier to work.

Because working ceramic bodies, such as fired ceramic molds and particularly cores has been considered more difficult, demanding and slow, and prone to breakage of the mold structures with attendant losses of productivity, little attention has been given to working such fired ceramics.

We have successfully attained rapid, effective ultrasonic machining of fired ceramic investment casting molds and mold components, both in the use of "point" tools, of limited size and shape, and in the development and use of productive and effective "form" tools, adapted to work surfaces of considerable area to a specific designed shape with precise and accurate dimensions.

Ultrasonic machining is reasonably developed in the art for working a variety of materials, including ceramic materials. In such techniques, a tool or sonotrode is developed having the desired conformation, and is mounted on a transducer which is caused to vibrate at ultrasonic frequencies, as by piezoelectric effects and the like. The tool or sonotrode is advanced onto the surface of a workpiece, with an abrasive medium interposed between the tool or sonotrode and workpiece surface. The vibrations are transmitted through the abrasive to effect working of the workpiece surface. Exaltation of the abrasive particulars abrades the workpiece surface leaving a precise reverse form of the tool or sonotrode shape.

Because of the limitations of ultrasonic transducers, the working surface area of the tool or sonotrode is generally limited to no more than about 100 $cm^2$, so that when larger areas are to be worked, the part or the transducer must be moved to different locations and again worked, often with a different tool or sonotrode, having different form suited to the particular area to be machined. Lower frequencies, in the sonic range may be used if desired, and are within the scope of the our usage of the term "ultrasonic machining" as employed herein.

In the case of smaller mode components, which can be spanned by an ultrasonic tool or sonotrode of acceptable area, we prefer to form the tool or sonotrode into the mirror image of the required surface, and work the mold component, such as a core insert, in a single operation.

With the ultrasonic tools of the present invention, the fired mold or mold components can be machined, cut or bored as required. While such machining operations are not common to mold making operations, the introduction of the present invention permits the development of structures not heretofore practical in casting operations or, more often, limited to the development of coarse structures which require reworking of the casting formed in the mold after it is formed.

In addition, the present invention will be employed to grind the surfaces of the fired mold or mold components to net size and shape from near-net conditions achieved in the original formation of the ceramic body. The ultrasonic machining techniques can grind the fired ceramic to dimensional tolerances substantially as closely as required, typically to −0, +0.1 mm, ordinarily on the order of −0, +0.05 mm or less and, if required, to −0, +0.02 mm. At this level, the dimensions are typically as fine as the grain size of the sintered ceramic, which is generally the limiting parameter of accuracy and precision in such grinding operations.

Similarly, the surface roughness can be readily reduced by ultrasonic polishing of the surfaces of the ground ceramic body, down to the limits of the grain size and porosity of the sintered ceramic. Further reductions in roughness may achieved by employing machining conditions which will machine the individual grains at the surface. For adequately dense ceramics, a glass-smooth surface, having a surface roughness of as little as 0.01 mm RMS, can be achieved, but is not often indicated or required.

The quality of the original molding of the ceramic green body, and particularly the density of the ceramic molding at the net surface is also a limiting factor, as the surface roughness of a highly porous ceramic can never be less than the porosity of the material. There will generally be a limit to the extent of surface working which will be required defined by the requirements of the molding to be formed, and those of ordinary skill in the art will have little difficulty in balancing the improvements in surface finish against the added processing time and cost involved. When polishing of the surfaces of the ceramic are appropriate, it is particularly convenient to employ the techniques disclosed and claimed in our prior patent, U.S. Pat. No. 5,187,899, the disclosure of which is hereby incorporated by reference herein. As noted above, it is also possible to employ a suitable coating to the machined ceramic surface to vill the voids and pores between the sintered particles.

A variety of ultrasonic generators which drive the transducers employed in the present invention are known and available.

It is preferred, in order to maximize the productivity and minimize the opportunity for error to employ generators which operate at a resonant frequency of the transducer-workpiece combination. Automatic resonance following generators of the type disclosed and claimed in U.S. Pat. No. 4,748,365 are preferred.

A variety of transducer components are commercially available, and any may be employed in the present invention which will convert the electrical signals produced in the generator into mechanical vibration at the appropriate applied frequency, typically by a piezoelectric effect, coupled to a booster which serves to amplify (or sometimes suppress) the amplitude of the vibrations.

The tools or sonotrodes which impart the vibration of the transducer to the abrasive to effect the machining operation. The sonotrode is typically a metal rod or bar of a suitable metal which has a resonant length suited to the frequency of the vibrations to be produced, for metals such as steel, aluminum or titanium, typical resonant lengths are from about 100 to about 150 mm, most often about 115 to about 140 mm.

The machining surfaces of the ultrasonic machining tool or sonotrode can be varied over wide limits, from quite small "point machining" tools having a working area of less than about 1 $mm^2$ up to a current maximum of about 100 $cm^2$. Small point machining tools are particularly appropriate for prototyping work, and may be helpful in final finishing and detailing operations in production, while larger area form tools are appropriate for production tooling.

The small "point machining" tools can be formed into variety of small shapes, including spherical, squared, circular, or conic sections, including truncated conic sections, and the like, to afford a convenient assortment to suit the particular machining requirements of particular operations.

Larger, form machining tools are generally shaped to directly produce the required shape, including three dimensional form, detailing and dimensions required of the fired ceramic. The shape of the tool or sonotrode will be a mirror image of the ceramic form to be machined, with suitable allowances for the gap between the tool or sonotrode and the fired ceramic.

When ceramic molds are to be machined over surfaces larger than the maximum size tool possible, or when opposing faces of the ceramic are to be worked or other shape constraints are involved, plural form and/or point tools are employed which, sequentially and collectively, are employed in machining the ceramic to the required form.

Figure 2A:
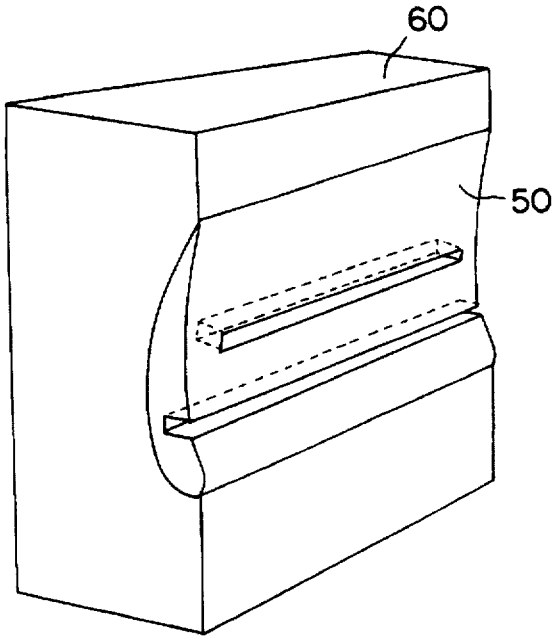
FIG. 2*a* is a schematic representation of a ceramic casting core mounted in a supporting fixture and FIGS. 2*b* and 2*c* are two opposed ultrasonic machining form tools for use in the present invention.
Figure 2B:
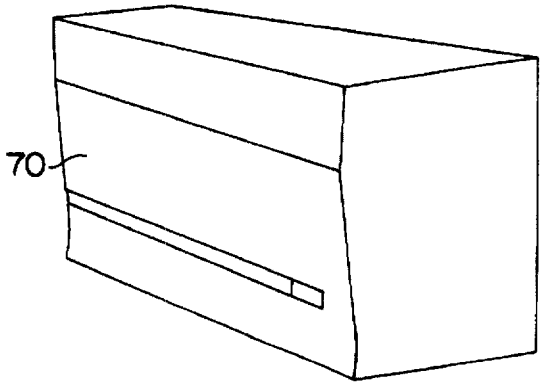
Figure 2C:
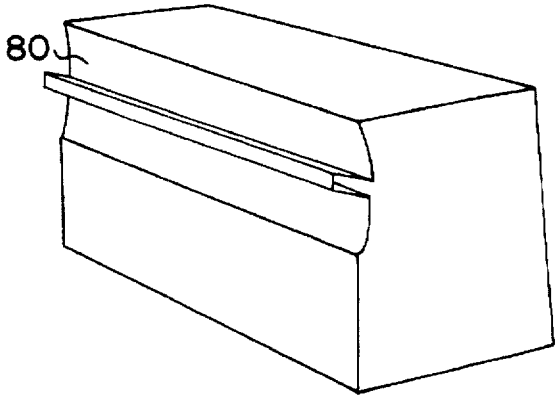

Plural form tools are illustrated in stylized fashion in FIG. 2, wherein a workpiece (50) is supported in a holder (60). A pair of ultrasonic machining tools (70, 80) are shown in faced opposition to the holder (60) and workpiece (50). The face of each tool is a negative image of the designed configuration of a corresponding portion of the workpiece surface. In FIG. 2, the workpiece is in the shape of a highly stylized and simplified form of a core insert for molding a turbine engine blade. In operation, the workpiece (50) is mounted in the holder (60), which is in turn mounted on a suitable support, not shown. One of the ultrasonic machining tools is mounted on a sonotrode carried on a ram to advance the tool into working position in relation to the workpiece, also not shown. The tool is advanced to machine a portion of the surface of the workpiece surface in registration and alignment. Once the machining with the first tool is complete, the tool is removed and replaced by the second tool, and the second tool is then advanced into working position in registration and alignment with the corresponding and mating surface portion of the workpiece, and performs the required machining on that portion of the workpiece surface.

As those of ordinary skill in the art will recognize, it will be possible to machine some shapes with a single form tool corresponding to the entire surface to be machined, while others may require more than the two shown in FIG. 2. The number of tools required for a particular workpiece will be determined by the size and shape of the workpiece. As a general rule, it will be preferred to employ the minimum number of tools sufficient to perform the machining operation for reasons of economy and productivity.

As those of ordinary skill in the art will also recognize, a number of existing machines can be adapted to perform the functions of supporting, aligning, registering and advancing the holder and its workpiece and the tools. Such equipment does not form a part of the present invention.

Any of the many tool materials commonly employed in forming ultrasonic machining tools may suitably be employed in the present invention. Most common in the art is the employment of high speed tool steel although in may cases, more abrasion resistant steel and non-ferrous alloys are employed. The selection of appropriate tool or sonotrode materials is not a critical feature of the present invention.

In many cases it is preferred to machine the working tool or sonotrode surface into the ultrasonic array, forming the required shaped directly in the sonotrode material.

When surface polishing is employed, in accordance with our prior U.S. Pat. No. 5,187,899, it is usual to employ a tool or sonotrode more readily machined in the operation than the ceramic part to be polished. Graphite tools are generally preferred in such operations.

As noted, the tool or sonotrode may be formed directly into the ultrasonic array, or may be separately formed and affixed to the working surface, of the sonotrode, by brazing or the like. In either case, the required shape and form of the tool may produced by any suitable machining technique. We generally prefer to employ orbital grinding, EDM, or a combination of both, for the rapid production of the required form with very high degrees of precision and reproducibility afforded. Such techniques also facilitate redressing of the tool or sonotrode as it becomes worn during ultrasonic machining operations.

Form tools may be provided with any shape desired, and with fine detailing as desired, providing the following constraints are observed:

The shape must be consistent with an axial advance of the transducer and tool or sonotrode into engagement with the ceramic structure to be machined. The tool or sonotrode cannot make undercuts, and separate machining operations, with a different orientation of the transducer and a different tool or sonotrode are generally required to produce undercut shapes. Because of the added complexity of the machining operation involved, such design features should be avoided whenever possible, although when required, additional operations can accommodate most shape requirements.

When this wall shapes are to be formed in the ceramic, such as fins, pins, posts, and the like, the minimum dimensions that can be tolerated are dictated primarily by the characteristics of the ceramic material. Since the ceramic to be worked is already fired, it will have far greater strength and durability in many respects than an unfired green body, but as the dimensions are reduced in thin walled, finely detailed structures, great care must be taken. It is may be desirable to design such features with at least some taper, if possible, to facilitate the advance and retraction of the tool or sonotrode and transducer without direct contact. A taper as little as one degree will be of some help, but when possible, a taper of 3 to 5 degrees is more typically employed. A taper is not a critical requirement, as the dimension of the cut will provide the gap between the tool or sonotrode and the workpiece, discussed above, on the order of at least about twice the diameter of the abrasive particles in the gap.

It is generally desirable that form tools be limited in size, as noted above, to no more than 100 $cm^2$. It is also convenient to limit the maximum dimensions of the tool or sonotrode to fit with in a circle having a radium of about 15 cm.

While the tool or sonotrode surfaces are generally formed of wear resistant materials, and in the case of machining, cutting and grinding operations, the material is more resistant to the ultrasonic machining effect of the operation than the ceramic workpiece, there will be wear, and over time the tolerances required of the tool will reach the limit of acceptability. At that point, the tool or sonotrode must be redressed, to restore the appropriate shape and dimensions, or be replaced by another, fresh tool.

In most cases, the tool or sonotrode will not lose tolerances until a substantial number of parts have been produced within acceptable tolerances. When the limit is reached, it is generally preferred to reform the tool by EDM, orbital grinding, or ultrasonic machining. A combination of these techniques may be employed. Typically, each tool or sonotrode may be redressed multiple times before too much material is lost to permit further redressing and reuse.

As previously noted, the abrasive work required in ultrasonic machining, grinding and polishing operations is most often performed by abrasive particles, dispersed in a fluid carrier, which is vibrated by the ultrasonic tool or sonotrode. In this fashion, it is the abrasive which actually transmits the working force to the workpiece surface, as an intermediate between the vibrating tool or sonotrode and the workpiece. The tool or sonotrode is thus never brought into direct contact with the work surface, and a gap is maintained between the tool or sonotrode and the workpiece. It is possible to avoid breakage of the tool or sonotrode through impact with the work, and to assure a flow of fresh, unworn abrasive into the gap during the operation. In addition, the debris generated by the working of the workpiece is washed away from the interface gap, and does not build up to levels which might interfere with the operation.

The fluid is employed to suspend and transport the abrasive into and out of the gap between the tool and the workpiece, to carry heat from the gap, and to flush the debris of the working operation out of the gap.

The nature of the fluid is not a critical matter so long as it is compatible with the tool, the ceramic and can perform the indicated functions. Any of the fluids commonly employed in the art may suitably be employed.

A wide variety of abrasives may be employed in the present invention, including all those typically used in prior art ultrasonic machining processes. For the ceramic materials to be worked in the present invention, we prefer to employ silicon carbide for relatively low density ceramics, such as silicon oxide and alumina based ceramics, and boron carbide to work high density ceramics formed of silicon nitride and silicon carbide.

The particles sizes of the abrasive are preferably on the order of about 25 to 75 mm in diameter, although when desired a broader range may be employed, so long as the gap dimensions between the tool or sonotrode and the ceramic workpiece are adjusted accordingly.

The frequency of the ultrasonic machining vibrations will normally be in the range of from about 200 to about 30,000 Hz. In some circumstances, lower or higher frequencies may prove more effective in working particular ceramics or in employing particular tool or sonotrode materials or both. We have practiced the present invention with an oscillation frequency as low as about 50 Hz, and as high as 50,000 Hz, both of which are outside the normal range connoted by the term "ultrasonic" but it should be understood that we employ the term in the broader sense of defining frequencies centered on the ultrasonic range, and extending both above and below audible limits, from about 50 Hz to about 50,000 Hz. Most often, the desired frequencies are those at which the combination of transducer, including any booster element, and the tool or sonotrode are resonant. For most tools, the resonant frequency is in the range of from about 15,000 to about 25,000 Hz, and preferably about 19,000 to about 21,000.

The amplitude of the oscillations during the machining operation is generally on the order of about 1 to about 1,000 micrometers, most often 10 to 250 micrometers, and preferably about 25 to about 50 micrometers.

The optimum frequency and amplitude will vary with the composition of the ceramic of which the mold is formed, and is readily determined by empirical techniques. It will be found, however, that the degree of improvement in optimum conditions does not vary greatly from other frequencies and amplitudes, and it is quite possible to operate at a fixed frequency and a fixed amplitude for all mold materials if desired.

The machining speeds typically achieved in working the ceramic materials in the present invention provide material removal at a rate typically on the order of 0.25 to 100 $mm^3$ per minute, varying with the amplitude of vibration, the abrasive grain size, and the specific characteristics of the ceramic. The rate of advance or penetration rate will correspondingly be on the order of about 0.25 mm to about 2.5 mm per minute, depending on the hardness and density of the ceramic. Typical surface finishes as worked will range from about 0.2 to about 1.5 μm RMS, with accuracies of −0, +0.1 mm typical, and when required, tolerances of as little as −0, +2 μm can be attained.

It will usually be preferable to assure that all surfaces of the mold or mold component to be worked in the present invention be well supported on the face opposite the surface being worked to minimize the bending moments applied which may tend to catch the brittle ceramic material. Fixtures for engaging and supporting the surfaces of the ceramic component are well within the skill levels common in the art.

A matched pair of supports, for the opposite faces of the mold or mold component, will ordinarily permit complete working of the workpiece in two sequential operations, while supported in each support fixture.

The effectiveness of the work is often enhanced by adding to the oscillations a periodic, preferably intermittent, relatively large amplitude reciprocation of the tool or sonotrode relative to the surface of the ceramic body. Such a reciprocation serves to "pump" the fluid and abrasive medium in the gap between the tool or sonotrode and the ceramic surface to assure a fresh supply of abrasive and a high homogeneity of the cutting medium. The orientation of the abrasive particles in the gap is changed during each pulse by a tumbling action during such reciprocations, assuring that fresh cutting edges and points are presented to the ceramic surface throughout the duration of the operation. A reciprocation of about 0.1 to 2.5 millimeters, at a frequency of about 0.1 to 5 Hz, for a duration of one or two cycles, will be effective for such purposes.

During high rate cutting and grinding operations, it may also be effective to impart to the tool or sonotrode an orbital motion superimposed on the ultrasonic vibrations of the tool. Such orbital motion can accelerate the cutting action on the ceramic surface by combining features of orbital grinding with the ultrasonic machining effects. The orbital motion serves to assure the homogeneity of the cutting medium in the gap between the tool and the ceramic surface, and to impart a working component of its own in a "lapping" type of action.

When orbital grinding is employed in combination with the ultrasonic machining operation, small orbits on the order of about 0.1 to 2 millimeters are generally most effective, at an orbital frequency of about 1 to 60 Hz.

When form tools are employed, it is preferred to employ a single axis operation where the tool and ceramic workpiece are mounted in facing orientation and one is advanced into engagement with the other, and then retracted when the machining operation is complete. Accuracy and reproducibility are dependent on alignment and registration of the tool and the ceramic workplace.

Typically, it will be convenient to mount the transducer and tool or sonotrode on a hydraulically, electrically or pneumatically driven ram, preferably in a tool changer mechanism of the general type commonly employed in the machine tool art, to facilitate rapid tool changes when required, and to assure precise and reproducible alignment of the tool. The ceramic workpiece will typically be mounted in a fixture which positions, aligns, and registers the workplace to the tool. The abrasive suspended in its liquid carrier may be introduced into the gap from one or more points located at the edge of the gap or through conduits provided through the sonotrode or the workpiece. The suspension is typically captured and recycled, preferably with cooling.

Once the tool and part are properly mounted, the ram is advanced to establish the correct gap and the generator is actuated to commence the machining operation. The ram is then advanced at a rate consistent with the rate of stock removal from the ceramic until the desired limit is achieved. It is often desirable to periodically interrupt the operation, retract the tool and then advance it into operating engagement again. The superimposition of such a periodic axial oscillation serves to force accumulated debris and worn abrasive out of the gap, and is aided by the flushing action of the imposed flow of the abrasive suspension. The action also provides enhancement of the cooling effect of the liquid flow in the gap. Both effects promote the precision of the machining operation. The amplitude is not critical and may range from 0.1 mm to 2.5 mm, and may occur at a pulse rate of from about once in five minutes to as often as 5 Hz. Typically, about one pulse every 10–30 seconds will be convenient.

When the size of the ceramic workpiece or the configuration of the tooling requires, the machining operation will often require the use of two or more tools. Often the axis of the relative motions required will differ. Such features may be provided in separate operations in serial fashion on separate equipment, or a single machine may be provided with plural rams at different alignments to the ceramic or more typically, the fixturing can be adapted to provide differing alignments, either by re-orienting a single fixture or providing a plurality of fixtures. When opposite sides of each ceramic workpiece are to be machined, it will generally be necessary to employ at least two fixtures.

The tolerances of the machining operation are conveniently monitored by conventional measuring and gauging techniques. Since the ceramic is normally non-conductive, contact-type measurements are generally preferred. It may be convenient to indirectly gauge the workpiece by measuring the tool, by contact or non-contact techniques to monitor wear, with periodic measurements of all or an appropriate sample of machined workpieces after the machining is complete. Since the cutting characteristics are very precisely predictable for a given operation, and since the engagement of the tool in relation to the fixture can be equally precisely controlled and reproduced, it may be unnecessary to measure the part itself during the machining operation.

Such operations have proved quite reliable, rapid, and effective at producing ceramic parts at reproducible tolerances as low as −0 to +2 μm (more typically about 0.1 to 0.02 mm) at levels exceeding 90%, often exceeding 95–98% of all parts processed. Production losses will ordinarily represent fractures of the ceramic during the ultrasonic machining and will most often be attributable to flaws in the fired ceramic structure. Production rates are dictated by the size and configuration of the ceramic part, the number of tools appropriate to the machining operation, and the quality of the near-net shaped ceramic blanks. To a lesser extent, the rate is also dependent on the hardness of the ceramic and tolerances required of the finished part. To exemplify what is possible, we have machined investment casting cores for turbine blade casting, discussed in detail below, to a tolerance of −0, +0.5 mm at a rate of 0.6 minutes (40 seconds) per part on a numerically controlled version of the preferred form tool machining apparatus described above.

These results are vastly beyond the capabilities of the state of the investment casting art. Where lesser tolerances are required, even higher production rates can be achieved.

It is possible to adapt the system to machine a plurality of ceramic workpieces at a time by mounting plural tools on one or more rams, and providing plural mating fixtures to mount a corresponding number of ceramic blanks. Through such processing, very high production may be attained with no reduction in tolerances.

When high production rates are not a primary concern, as during prototype and design development of castings, for limited production runs, or other specialized applications, the time and expense of form tool development may not be cost effective. In such circumstances, we prefer to employ one or more point tools, as described above, mounted on a numerically controlled multi-axis tool carrier which can orient and move the tool into engagement with a fixtured ceramic workpiece. A diversity of multi-axis machine tools can be adapted to the requirements, and achieve tolerances suitable to the present invention. Machine tools adapted for traditional machining operations, such as milling cutters and the like can readily withstand the ultrasonic vibrations involved in the present invention, as they are substantially lower amplitude and magnitude than the vibrations usually encountered by such machines. Resonant vibrations within the multi-axis system may be readily damped if required.

As those of skill in the investment casting art will recognize, all the precision gained in the fabrication of mold parts, and particularly mold cores, is wasted if the parts cannot be aligned with comparable precision during assembly and forming operations in which they are employed.

The positioning of a core element in a waxing mold is exemplary of the acute problems that can arise in casting. Despite the quality of the waxing mold and the core insert, any error in positioning the core within the waxing mold when the wax medium is injected will introduce a reduced wall thickness where the core is positioned too dose to the mold wall, and a corresponding increased wall thickness in opposition. Such errors often are resolved by over-design of components, adding surplus weight and material to cast parts.

It is possible to employ core locating pins, integrally molded into the core structure or, more commonly, mounted on a core holding fixture developed within the waxing mold. Such pins leave a hole within the was pattern when separated from the waxing mold which may be filled by customary was pattern finishing techniques, or which in some cases may be left in place to be filled with the ceramic formulation in subsequent dipping to produce a corresponding hole through the casting. Such holes are often desired, for example, to provide cooling air flow from the hollow core to the surface in the case of turbine engine blades, although locating pins of a diameter suited to such air flow porting may be rather fragile.

It is within the reach of the present invention to facilitate such techniques for alignment by providing highly precise datum points to accurately form and locate such pins on the surface of a core insert, assuring the alignment of the core within the waxing mold with great precision, down to the tolerances of the machining operation.

In situations where operations produce ceramic cores to acceptable tolerances, but waxing mold assembly operations introduce unacceptable errors, it may prove highly effective and productive to limit the machining operation of the present datum points, without ultrasonic machining of the entire part. The equipment, tooling, and fixturing requirements of such operations can be quite simple, permitting cost effective upgrades in the quality of production of existing castings.

The size, number, orientation, and shape of datum points will be dictated by the design of the core and the locating pins to be employed. A point tool or form tool to conform the datum point conformation to mate with and engage the ends of the pins I undemanding. Ultrasonic machining limited to the formation of such datum points can be quite rapid, even at very tight tolerances.

Due caution should be taken to note that when the ultrasonic machining is limited to datum points, no correction is made of twist, bending, or warping of the ceramic during its firing, densification, and shrinkage. If the fully fired ceramic part is outside acceptable tolerances, full form machining as described above should be employed. Nor can the highly accurate and precise placement of datum points overcome the limitations of poor design or fabricating techniques.

As in any other techniques for the development of investment casting molds, appropriate allowances must be determined and made for the extent of shrinkage of the casting as it cools. While the techniques to be employed will be the same as those familiar to the art, it is notable that changing the molds to adjust the dimensions to highly precise results is far easier and more rapid by the specific application of these techniques to the working procedures employed in the present invention. Indeed, even very slight adjustments, previously left to grinding and polishing of the casting, can be readily made to the mold shells and cores in the practice of the present invention. As a result, it is possible and practical to produce castings of unparalleled precision and accuracy in the present invention. Because of the dimensional achievements, the castings produced in the present invention require little or no surface working to correct the dimensions, even to the extent that the surface finish of the molds are of much greater importance. For many castings, the part can be employed as cast, with no grinding of the cast surface, and a good surface finish is often necessary to obtain the full benefits of the invention.

As set out in full detail in the disclosure of our prior patent application Ser. No. 07/454,290, surface finish of the ceramic parts may formed, ground and polished to substantially any degree of dimensional accuracy and precision, and any level of surface finish required in the casting. It should be noted, however, that polishing of the mold surfaces may be limited by the shrinkage of the casting during the cooling of the metal melt to a solid phase, and during the cooling of the solid, since the shrinkage may draw the casting out of contact with the surface of the mold before the surface is fully solidified, and permitting the alteration of the surface finish imparted by the mold surface by syneresis. Polishing the mold beyond the limits of the casting operation is self evidently unnecessary and wasteful, and should not be employed. The appropriate its to be employed are a function of the size of the casting and the shrinkage characteristics as the Four cools and solidifies. An as-cast surface finish of better than about 10 microinches RMS is generally not obtained by casting of metals.

The pour of molten metal into the molds made by the present invention are not altered by the present invention, and good molding practice well understood in the art is My effective. Such techniques as centrifugal casting, where the mold and the molten metal are rotated to enhance flow of the melt into the mold cavities and to achieve other beneficial effects may be employed with the present invention to good effect.

It is increasingly common to employ inserts of preformed structures, high melting point metal or ceramic fiber reinforcing, and the like into investment casting molds prior to pouring the melt. These practices are fully compatible with the present invention and will, in fact, ordinarily be facilitated by the reduced requirements for working the casting surfaces. With reduced working of the casting surfaces, there is less tendency for such inclusions to become exposed at the casting surface, which is ordinarily an important consideration.

As in the usual techniques for investment casting, it will be common to present the mold and its inserts prior to the pour to temperatures comparable to the melt temperature or at least above the solidus temperature of the melt to avoid premature solidification of the metal during the pour. After the pour is complete and the cast melt is degassed, if required, and all the steps necessary to assure the mold cavity is fully filled by the metal melt, the cooling of the mold and the metal is begun.

A cooling schedule will be dictated by the characteristics of the metal of which the casting is being formed. These requirements are not altered by the present invention, and are generally known to those of ordinary skill in the art.

Once the metal is solidified to the required point, the mold is removed. The shell is most often removed by mechanical means, including hammer and/or sand blasting.

Internal cores may be removed by hammering or sand blasting in some cases. In others, the core will not be accessible to such techniques, and may require chemical or solvation effects to achieve proper and sufficient removal. These are techniques which are in common use and well known to those of ordinary skill in the art. The ceramic material must be chosen from among those developed for these purposes, as not all ceramics are amenable to solvent or chemical removal techniques, as those of ordinary levels of skill are well aware.

The metal castings produced in the present invention will be found to consistently afford very high quality castings. It will, nonetheless, be necessary to remove sprues and gates attached to the part. An occasional flashing, reflecting a crack in the mold, will occur. The usual cutting, grinding and polishing techniques common in the art will be employed.

With reasonable care in the practice of the present invention, however, the casting will have an excellent surface finish which in many uses will require little or no grinding or polishing for the intended use. When necessary, polishing to achieve higher surface finish which in many uses will require little or no grinding or polishing for the intended use. When necessary, polishing to achieve higher surface finish, such as fine mirror surfaces, will be achieved with a minimum of polishing work.

It is, of course, less necessary to give substantial attention to surface finish for many parts where surface finish and polish are not significant to the usage of the casting, as for surfaces which will not be seen or required to operate in a fashion affected by surface finish. Castings which are to be subjected to forging operations do not benefit from a high surface finish. In such circumstances, it will not be necessary to conduct polishing operations on the mold surfaces, and the rate of production is increased and the cost of operations is reduced accordingly.

The surface finish of interior bores and cavities will also be as fine as the limits of the mold polishing operation as discussed above. Final polishing operations, if required, can be efficiently attained as a result of the high quality of the initial finish of the surfaces, and may be effected by any of the usual techniques employed in the art, including particularly abrasive flow technology available from Extrude Hone Corporation in Irwin, Pa..

In order to exemplify the present invention and to demonstrate the preferred features and best mode for carrying out the invention, the invention has been employed in the process of investment casting of gas turbine engine blades. Such blades are among the most difficult and demanding of casting operations, for a variety of reasons, and the quality of the casting is critical to the safe and effective of turbine engines in all their applications, including aircraft engines, where human lives are dependent on the manufacturing operations.

While the castings for turbine blades are made in a variety of techniques, modem turbine engines are dependent on aerodynamically complex blade shapes and, most demandingly, structurally complex hollow interior configurations to provide weight reduction, cooling air flow and air ejection through porting in the surface of the blade to provide air flow control and a cooling barrier layer around the surface of the blade.

Turbine engine design considerably exceeds contemporary manufacturing capabilities, particularly in the precision and accuracy of investment casting, so that allowances and compromises in the design must be made to offset the limitations of current technology. The most variable and difficult aspect the casting of such turbine blades is in the variability of the casting cores and their alignment in waxing molds, which operations define the interior hollows of the blades and the wall thickness of the casting.

A stylized turbine blade is illustrated in FIG. 1, showing the general exterior configuration and, in the cutaway portion, some of the interior structure. As shown in FIG. 1, the turbine rotor blade casting (10) is made up of two major portions, the blade (20) and the "Christmas tree" (30), which mates with one of a number corresponding shapes in a rotor disk, not shown, which receive a plurality of such blades in a annular ring to make up the turbine rotor.

The exterior surfaces of the blade are structurally relatively simple, although the shapes are highly developed. The shape of the blade surfaces are provided by the configuration of the interior of the waxing mold, with due allowances for shrinkage of the metal in the casting operation. The shape of the blade (20) is dictated by aerodynamic design parameters, while the shape of the "Christmas tree" (30) is dictated by the requirements of mounting the blade on its rotor disk. For other blade assembly techniques, other shapes and configurations may be employed, including integral casting of the rotor disk with its appended blades, or the development a shape adapted to be welded to the surface of the rotor disk.

The interior configuration is more complex, with serpentine air flow passages (12), provided with ribs (14) which serve to reinforce the metal blade structure and to control the turbulence and cooling effect of the air flow through the passages. The passages transport pressurized air through the blade from an inlet (16) from the central rotor disk to the exit ports (18) provided through the blade surface along the leading and trailing edges and at the blade tip. Thin wall sections of blade (20) adjacent the trailing edge (22) are supported by integrally cast posts (24), which provide structural reinforcing of the blade (20) and, the like the ribs (14), serve to influence the passing air flow. All these features must be provided in the casting by the blade core, as the interior of the casting is not accessible to machining operations after the casting is complete and the core is removed.

Figure 3A:
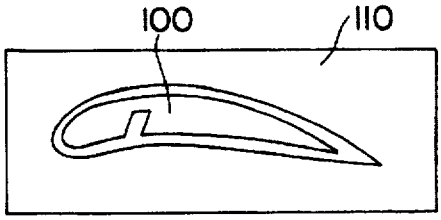
FIG. 3*a* is a schematic cross section through a waxing mold, illustrating a correctly aligned core within the mold.
Figure 3B:
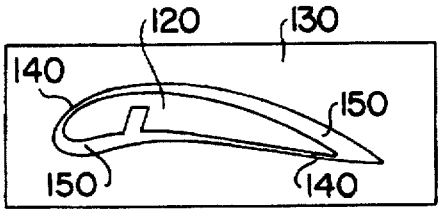
FIG. 3*b* is a schematic cross section through a waxing mold, showing a core misaligned within the mold.

The core has a highly complex and intricate form, necessary to provide the interior configuration of the turbine blade casting as described above. Indeed, every feature of the interior structure of the blade has a corresponding negative feature in the core, making the formation of the core to the precision and accuracy required a highly demanding aspect of the casting operation. The state of the art is not capable of such precise development of ceramic cores, and the limitations of the core forming operations are fed back into the engine design process to make allowances for these limitations. Common design allowances dictated by the variability of core manufacture are greater thickness of the wall sections of the blade, greater rib sizes than are required by structural demands, and enlarged diameter of supporting posts. The wall thickness employed must also make due allowances for the common levels of misalignments in the waxing mold. In FIG. 3, two conditions of alignment are shown in stylized cross-sections of molds and cores. FIG. 3*a* shows a well aligned core (100) positioned within a mold (110), with substantially uniform spacing between the mold and core, which will in turn produce a hollow casting with substantially uniform wall thickness. FIG. 3*b* illustrates the effect of a misaligned core (120) within a mold (130) wherein the core is twisted by two degrees relative to the mold. As shown the core mmisalignment produces a very thin spacing in some areas (140) and wider than designed spacing at other locations (150). When a casting is formed in such a mold, the wall thickness will lack the intended uniformity, and will have thin portions which lack the designed structural properties, and other areas which are over-thick, and exceed the required structural characteristics and intended weight. It is common in the art to increase the design weight of the blade structure by ten to fifteen percent to accommodate such allowances.

Excess weight in turbine engines is well known to be undesirable in all contexts, particularly in aircraft powered by such turbine engines. Excess weight in the turbine rotor blades is particularly undesirable in turbine engines for tactical military aircraft, where abrupt, substantial and rapid changes of thrust are necessary and usual aspects of operation.

The most common and significant sources of core forming errors which presently dictate engine design compromises, and which are overcome by the present invention, include the following:

A. the minimum diameter of the posts (24) in the blade is dictated by the minimum size hole that can be molded in situ within the core structure, which is effectively limited to about 0.5 mm diameter in the prior art. The alternative is to drill holes in the core green body after forming, which is ordinarily the source of excessive and unacceptable cracking and core losses, but which can provide posts of about 0.3 mm diameter. As discussed below, the ultrasonic machining techniques of the present invention can form reliable hole for the formation of posts in the casting down to 0.05 mm in diameter if desired or required. Their number, locations and arrangement is largely unlimited.

B. The cast ribs (14) are limited in the prior art techniques by the extent of shrinkage during firing to a minimum thickness of about 0.3 mm, and a maximum height of about 0.5 mm. In the present invention, the thickness of the ribs can be as small as 0.05 mm, and may be through cut if desired, i.e., with no maximum depth.

C. During firing, the development of span-wise bending, chord-wise warping, and tip-to-root twist can develop, creating deviations in shape from the design of typically +/−0.75 mm or more. In the present invention, deviations from design shape can be limited to minus zero, +0.02 mm.

D. Trailing edge thickness typically varies ±0.15 mm in prior art practice. In the present invention the variation can be limited to minus zero, +0.002 mm.

E. Mislocation of the core within the waxing mold by state of the art techniques, and in light of the dimensional variation of the core structure itself, and produce casting wall thickness variations of up to as much as 0.75 mm, in a casting typically about 1.5 mm in nominal design thickness. See FIGS. 3*a* and 3*b*. The errors in core formation and mounting are often cumulative. With the full development of the potential of the present invention, the variation in casting wall thickness can be limited to 0.02 mm, representing an improvement of more than 3,500%.

F. Current core development techniques, even with the foregoing limitations, result in a rejection rate of 10 to 20% of core moldings through cracking, fractures, out of specification parts and other errors. In the present invention, since the molding and firing of the cores is not so demanding, the useable cores produced in the present invention, even at the far higher specifications, exceeds 95%, and often 98% or more.

The procedure of making the turbine blades follows the normal sequence of investment casting techniques, with the introduction of the ultrasonic machining of the ceramic core structure after its firing and densification. In summary, the sequence of operations in the procedure includes the steps of:

1. Forming a fired ceramic molding core to near net shape and dimensions. As described above, the usual techniques for the formation of such cores can be greatly accelerated, since the difficult aspects of molding core bodies is in achieving the exacting targeted design shape for the structure. Such precision is not required, and the near net shape is rapidly and easily attained within the allowable tolerances of the operation. Fine detail of the structure may, in many cases, be ignored in the development of the core blank, and be left for development solely by the ultrasonic machining operation. Indeed, an experienced shop may well be able to provide a suitable fired core to appropriate tolerances on the first attempt. Since the molding of the green body and the firing operation do not require the high levels of precision usual to investment casting technology, a major development period and a substantial component in tooling development time is eliminated, and the operation can be productive without the numerous iterations in the development of each core iteration. In addition, in many circumstances, the same core bank can be employed in multiple core development iterations in finalizing the design, permitting changes in the core mold to be by-passed altogether.

2. Shaping the ceramic core to net shape and dimensions by ultrasonic machining. Since the shaping operation is governed by the ultrasonic tools employed, it is their operation which is the key to the rapid development of the final core configuration, to the required tolerances and precision. Since the generation of prototype cores during the design development cycle is conducted, in the preferred form of the invention, by one or more standardized point tools mounted on a multiaxis numerically controlled system, new core shapes can be produced as soon as the desired design changes can be developed in the programming of the machine tool system. The additional steps of fabrication of production form tools is deferred until the final configuration is fixed, and is no longer the subject of iterative development. Again, a major component of potential delay in the design development cycle is eliminated.

Once the design is fixed, production form tools are formed by highly efficient and productive techniques such a EDM to the required configuration and tolerances, and put into immediate production.

An additional virtue of the present invention is that the tolerance determining operations, i.e., the ultrasonic machining operations lends itself to numerically controlled operation and quality control. This in turn permits the development of the programming directly from design data, which can be transferred electronically into the numerical control system, and converted into the ultrasonic machining control form through programming, often directly from the designers CAD software. A significant improvement in the reliability of the development process results from such operations, both in speed and in the avoidance of the opportunity for the introduction of errors in the translation of the design into a specific core or mold structure.

3. Mounting the machined ceramic core in a waxing mold. As discussed above, the precision of the core, coupled with mounting pins within the waxing mold or fixed on the surface of the core assure highly precise and reliable positioning of the core within the waxing mold, and the substantial elimination of the errors normally encountered in such operations.

In the design development cycle, the designer has considerable assurance that the result of the casting operation conforms to the intended design, and that the date produced in testing are valid representations of the design without undue variation as an incident of the molding techniques and their limitations. Subsequent production benefits from the far greater reliability and quality control is greatly simplified. The incidence of out of spec parts is greatly reduced, significantly improving the costs and productivity of the operation.

4. Forming a wax form within the waxing mold including the ceramic core. Because the precision of the core and its alignment within the mold are comparable in tolerances with the structure of the mold itself, the was filling operation is greatly facilitated in its uniformity and reliability. The thickness of the wall forming portions of the wax pattern are no longer the highly variable feature they have traditionally been.
5. Removing the wax form from the wax in the mold. These operations are unchanged in the present invention, although it has been observed that the greater uniformity of the wax pattern makes the operations more predictable and reliable.
6. Coating the wax form with a ceramic mold forming slip proceeds normally.
7. Drying the slop benefits, in the context of the present invention from the reduced incidence of cracking of the forming green body by coming into contact with a distorted or misaligned core structure as the ceramic formulation shrinks. In usual operations, a significant number of molds are destroyed or damaged in the drying operation, a phenomenon which is largely eliminated in the present invention.
8. Heating the green body to remove the wax and to densify and fire the ceramic to form an investment casting mold including the ceramic core. The shrinkage of the mold which occurs during the firing operation is another traditional source of loss of the molds in the case of misshapen and misaligned cores, and in the present invention is no longer a problem.
9. Pouring molten metal into the casting mold. The greater uniformity of the mold, with the core inclusion, assures consistent filling and flow of the molten metal within the mold, significantly improving the productivity of the operation. The pouring operation is itself unchanged.
10. Cooling the molten metal to a solid is more predictable and controllable, since the part is more uniform dimensions. As a result, the techniques for determining the microstructure of the metal through controlling the conditions of the cooling operation are more reliable and productive.
11. Removing the ceramic casting mold and the ceramic core from the solid metal. Because there are fewer variations in the wall thicknesses of the metal part, there is reduced incidence of damage to the part in the course of removing the ceramic materials from the completed cast part. Other operations on the casting, including assembly with other parts, finishing operations, and the like are far less likely to damage an under-specification thin wall or other departure from the designed scantlings of the part.
12. Testing, use and redesign of the part can be repeated as required during the design development stage. As the design is improved and refined, additional iterations can produced with minimal lead time, often with nothing more than a change in the programming of the numerical control system of the ultrasonic machining operation. For the first time in many years the manufacturing and prototyping operations can keep pace with, and in some respects now lead, the design and development process. These developments will permit turbine engine designers to further advance the state of their art, which heretofore has been hindered by the production limitations, and the need to design in allowances and margins of error dictated by the high variability and lack of precision in cast parts. The assurance of investment casting of complex parts, such as turbine blades, to the close and highly uniform and reproducible tolerances attained in the present invention is a significant advance in the art. The reduced development cycle time will also assist in the rapid development of better designs assure their effective production when the design is fully developed.

The foregoing description and specific examples are intended to illustrate the present invention, and to guide and enable those of ordinary skill in the art in the practice of the invention, in combination with the common practices usual and customary in the art, and are not intended to be limiting on the scope of the invention. The scope of the invention is set out in specific detail in the following appended claims which define the limits of the invention.

What is claimed is:

1. A method of investment casting a complex three dimensioned shape with a ceramic mold comprising the steps of:

A. Forming a ceramic mold of a sintered ceramic;

B. Shaping at least a selected three dimensioned shaped part of said sintered ceramic mold by ultrasonic machining working of the surface of said sintered ceramic mold;

C. Pouring molten metal into said mold;

D. Cooling said molten metal to a solid casting; and

E. Removing said mold from said casting.

2. The method of claim 1 wherein at least said selected portion of said mold is machined by ultrasonic machining to a shape having a tolerance of at least ±0.2 mm and a surface finish of from about 0.2 to about 1.5 μm RMS, employing a particulate abrasive and a formed sonotrode conforming to a negative image shape of said selected part of said sintered ceramic mold and allowing a gap between the surface of said mold and said sonotrode of at least about twice the largest dimension of said particulate abrasive.

3. The method of claim 2 wherein at least said selected portion of said mold is machined by ultrasonic machining to a tolerance of at least minus zero, +0.05 mm.

4. The method of claim 2 wherein at least said selected portion of said mold is machined by ultrasonic machining to a tolerance of at least minus zero, plus 0.02 mm.

5. The method of claim 2 wherein at least said selected portion of said mold is machined by ultrasonic machining by at least one form machining sonotrode having an area of from about 5 to about 100 $cm^2$.

6. A method of investment casting a complex three dimensioned shape with a ceramic mold comprising the steps of:

A. forming a fired ceramic molding core to near net shape and dimensions;

B. shaping said ceramic core to net shape and dimensions by ultrasonic machining working of the surface of said sintered ceramic mold;

C. mounting said machined ceramic core in a waxing mold;

D. forming a wax form within said waxing mold including said ceramic core;

E. removing said wax form from said waxing mold;

F. coating said wax form with a ceramic mold forming slip;

G. drying said slip;

H. heating said slip to remove said wax and to densify and fire said ceramic slip to form an investment casting mold including said ceramic core;

I. pouring molten metal into said casting mold;

J. cooling said molten metal to a solid; and

K. removing said ceramic casting mold and said ceramic core from said solid metal.

7. The method of claim 6 wherein at least said selected portion of said mold is machined by ultrasonic machining to a tolerance of minus zero, +0.05 mm to a tolerance of at least ±0.2 mm and a surface finish of from about 0.2 to about 1.5 μm, employing a particulate abrasive and a formed sonotrode conforming to a negative image shape of said selected part of said sintered ceramic mold and allowing a gap between the surface of said mold and said sonotrode of at least about twice the largest dimension of said particulate abrasive.

8. The method of claim 7 wherein at least said selected portion of said mold is machined by ultrasonic machining to a tolerance of at least minus zero, +0.05 mm.

9. The method of claim 7 wherein at least said selected portion of said mold is machined by ultrasonic machining to a tolerance of at least minus zero, plus 0.02 mm.

10. The method of claim 7 wherein at least said selected portion of said mold is machined by ultrasonic machining by at least one form machining sonotrode having an area of from about 5 to about 100 $cm^2$.

11. A method of forming a shaped ceramic mold for investment casting a complex three dimensioned shape comprising the steps of:

A. Forming a near net shape ceramic mold of one or more parts formed of a sintered ceramic;

B. Shaping at least a selected part of said sintered ceramic mold by ultrasonic machining working of the surface of said sintered ceramic mold to designed three dimensioned shape and tolerances.

12. The method of claim 11 wherein at least said selected portion of said mold is machined by ultrasonic machining to a tolerance of minus zero, +0.05 mm to a tolerance of at least ±0.2 mm and a surface finish of from about 0.2 to about 1.5 μm, employing a particulate abrasive and a formed sonotrode conforming to a negative image shape of said selected part of said sintered ceramic mold and allowing a gap between the surface of said mold and said sonotrode of at least about twice the largest dimension of said particulate abrasive.

13. The method of claim 12 wherein at least said selected portion of said ceramic mold is machined by ultrasonic machining to a tolerance of at least minus zero, +0.05 mm.

14. The method of claim 12 wherein at least said selected portion of said ceramic mold is machined by ultrasonic machining to a tolerance of at least minus zero, plus 0.02 mm.

15. The method of claim 12 wherein at least said selected portion of said ceramic mold is machined by ultrasonic machining by at least one form machining sonotrode having an area of from about 5 to about 100 $cm^2$.

16. A method of forming a shaped core for investment casting a complex three dimensioned shape with a ceramic mold containing said core therein comprising the steps of:

A. Forming a ceramic stock shape of a sintered ceramic;

B. Shaping said sintered ceramic stock shape by ultrasonic machining working of the surface of said sintered ceramic mold to designed core shape and tolerances.

17. The method of claim 16 wherein at least said selected portion of said mold is machined by ultrasonic machining to a tolerance of minus zero, +0.05 mm to a tolerance of at least ±0.2 mm and a surface finish of from about 0.2 to about 1.5 μm, employing a particulate abrasive and a formed sonotrode conforming to a negative image shape of said selected part of said sintered ceramic mold and allowing a gap between the surface of said mold and said sonotrode of at least about twice the largest dimension of said particulate abrasive.

18. The method of claim 17 wherein said core is machined by ultrasonic machining to a tolerance of at least minus zero, +0.05 mm.

19. The method of claim 17 wherein said core is machined by ultrasonic machining to a tolerance of at least minus zero, plus 0.02 mm.

20. The method of claim 17 wherein said core is machined by ultrasonic machining by at least one form machining sonotrode having an area of from about 5 to about 100 $cm^2$.

* * * * *